United States Patent [19]

Gatling

[11] Patent Number: 4,905,877

[45] Date of Patent: Mar. 6, 1990

[54] ADJUSTABLE GARMENT HANGER

[76] Inventor: Jean M. Gatling, 1918 W. Bristol St., Philadelphia, Pa. 19140

[21] Appl. No.: 229,912

[22] Filed: Aug. 8, 1988

Related U.S. Application Data

[63] Continuation-in-part of Ser. No. 80,017, Jul. 31, 1987, abandoned.

[51] Int. Cl.[4] ..... A47G 25/44; A47G 25/48

[52] U.S. Cl. ..... 223/90; 223/94

[58] Field of Search ..... 223/89, 90, 94, DIG. 4, 223/88, 98

[56] References Cited

U.S. PATENT DOCUMENTS

| | | | |
|---|---|---|---|
| 1,880,963 | 10/1932 | Kraft | 223/DIG. 4 X |
| 2,232,249 | 2/1941 | Losin | 223/DIG. 4 X |
| 2,360,119 | 10/1944 | Gallagher | 223/89 |
| 2,491,836 | 12/1949 | Simmet | 223/89 |
| 2,804,245 | 8/1957 | Brondllio et al. | 223/90 |
| 2,817,471 | 12/1957 | Stoschy | 223/90 |
| 2,904,233 | 9/1959 | Brothers | 223/88 |
| 3,005,579 | 10/1961 | Thurber | 223/89 |
| 3,039,662 | 6/1962 | Strong | 223/89 |

FOREIGN PATENT DOCUMENTS

| | | | |
|---|---|---|---|
| 1236341 | 6/1960 | France | 223/89 |
| 1359665 | 3/1964 | France | 223/89 |
| 469185 | 2/1952 | Italy | 223/89 |
| 25453 | of 1910 | United Kingdom | 223/90 |
| 887020 | 1/1962 | United Kingdom | 223/89 |

*Primary Examiner*—Werner H. Schroeder
*Assistant Examiner*—David K. Suto
*Attorney, Agent, or Firm*—Volpe & Koenig

[57] ABSTRACT

The adjustable garment hanger of the present invention has a main body member having a pair of oppositely extending arms engaged within a pair of auxiliary sleeves which may be adjusted to provide a hanger arm of variable lengths. Each of the opposed arms is biasable such that the sleeve may be slideably moved over the arm. The sleeves are held in a fixed position relative to the main body member when the arm is in an unbiased position. The sleeves are provided with support means which are slideably engaged with the underside of the top edge of the main body member so that when the sleeves are extended to their greatest extremity, no dipping occurs.

9 Claims, 4 Drawing Sheets

20
13
14
15
16
24
23
15
A
B
40
41
10
11
11
12

13
24
22
20

21
28
25
26
22
27
29

ADJUSTABLE GARMENT HANGER

CROSS REFERENCE TO RELATED APPLICATIONS

This Application is a Continuation-in-Part of U.S. Application Ser. #07/080,017 Filed July 31, 1987 now abandoned.

BACKGROUND OF THE INVENTION

1. FIELD OF THE INVENTION

The present disclosure relates to an adjustable garment hanger. More particularly, the present disclosure relates to an adjustable garment hanger having a pair of oppositely oriented arms which extend outwardly from a vertical center line, over which arms are fitted sleeves which can be adjusted inwardly or outwardly to support apparel having various shoulder widths.

2. DESCRIPTION OF THE PRIOR ART

Numerous devices having extensible arms for accomodating various sizes of garments have been disclosed in the prior art. For example, U.S. Pat. No. 2,360,119 to Gallagher discloses an adjustable hanger with inwardly and outwardly slideably mounted sleeves which completely surround, or surround to at least 180°, the lateral crossbar piece and the angular shoulder supporting portions of the hanger. U.S. Pat. No. 2,817,471 to Stoschy discloses an adjustable hanger having a crossbar which is suspended from the arms by a suspension means, and adjustable sleeves which fit over the ends of the hanger arms and are slideably mounted inwardly and outwardly and can be adjusted to a given desired hanger size by spring actuated adjustable stop means. U.S. Pat. No. 2,496,561 discloses an adjustable coat hanger having slideable rods maintained under pressure by a spring and adjusted by means of a pull string. U.S. Pat. No. 2,754,039 discloses a device wherein the extendable arms are slideably mounted within the main body arms and are held in position by a resilient strip preferably made of spring steel.

A major disadvantage of adjustable hangers disclosed in the prior art has been the inability to combine the desired functionality which one would seek in an adjustable hanger with simplicity of design and a concommitant low manufacturing cost which would render the manufacture of an adjustable hanger an economically attractive endeavor. In accordance with the present invention, an adjustable hanger is disclosed which combines functionality with simplicity of design, thereby avoiding the drawbacks of prior art disclosures.

SUMMARY OF THE INVENTION

The adjustable garment hanger comprises a main body member having a pair of oppositely oriented arms extending outwardly from a vertical center line, said main body member being affixed with suspension means oriented along said vertical center line for suspending said hanger from a support, each of said arms being comprised of top and bottom edges connected by an end piece at their outer extremities said top and bottom edges being either biasable toward each other or said top edge being rigid and said bottom edge being upwardly biasable toward said top edge and a pair of sleeves, each of said sleeves having at least one open end and slideable at said open end about said top and bottom edges of said arms when said arms are in their biased position, and said sleeves being held in a fixed position relative to said arm when said arms are in an unbiased position, said sleeves being provided with support means which engage the underside of said upper edges of said arms of said main body member.

DETAILED DESCRIPTION OF THE INVENTION

Figure 6:
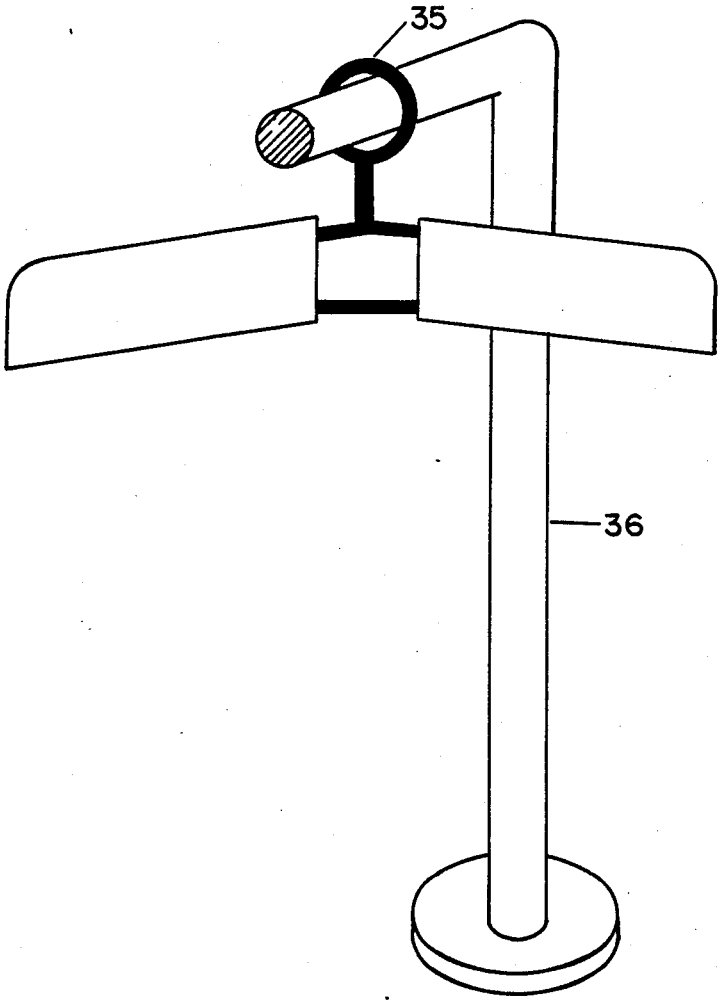
FIG. 6 shows another preferred embodiment of the invention in which the suspension means is a continous loop and the support means is a floor-mounted stand.

In a preferred embodiment of the invention, the adjustable garment hanger comprises a main body member 10 having a pair of arms 11 extending outwardly in generally opposing directions from a vertical center line 12. Main body member arms 11 are engaged within sleeves 20 to form the extensible arms of the hanger. The main body member 10 has a suspending means 40 such as a hook 41 or a completely enclosed circular suspension means 35 as shown in FIG. 6 for suspending the garment hanger from a support means. The support may be stationary such as the crossbar in a closet, or non-stationary such as the cross-piece on a dress truck or a wardrobe trunk.

Figure 1:
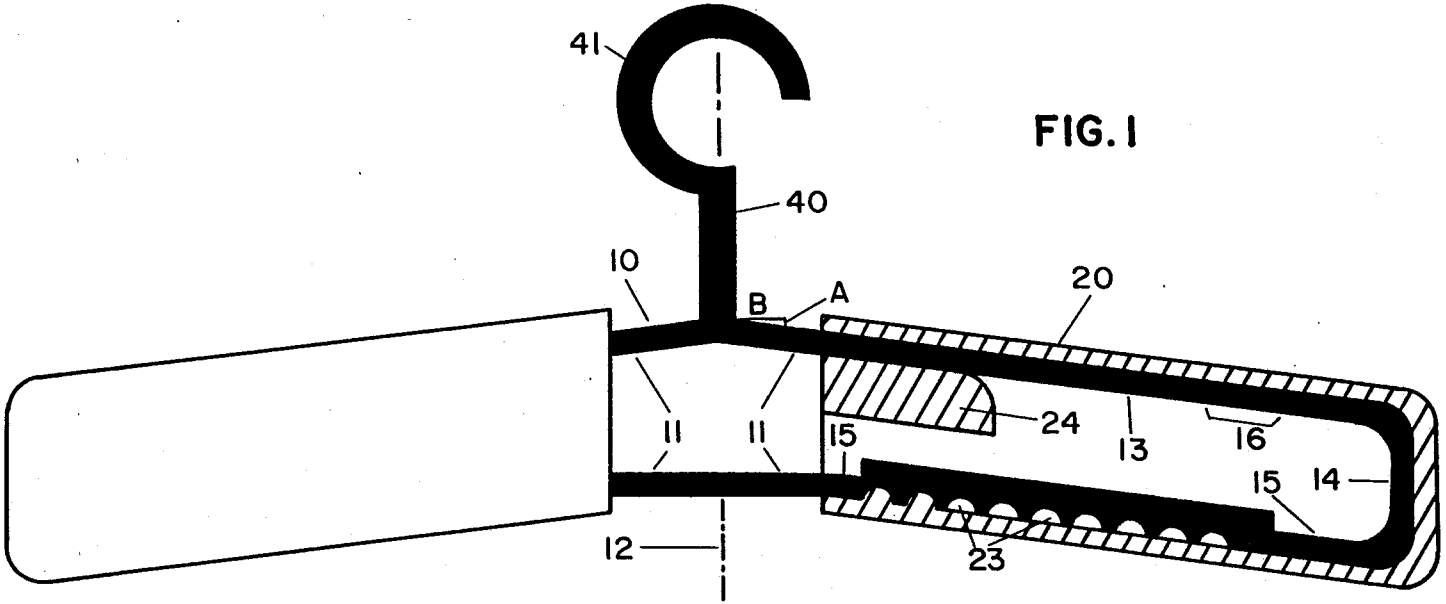
FIG. 1 is a front elevation view, partly in section and partly broken away to show the construction of a preferred embodiment of the invention.
Figure 3:
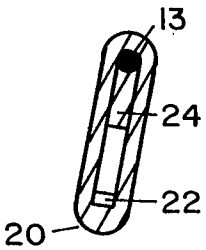
FIG. 3 is a cross sectional view of the sleeve.
Figure 4:
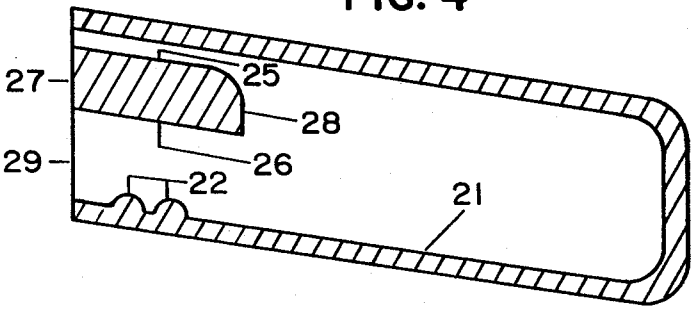
FIG. 4 is a front elevation of the sleeve showing details of construction.
Figure 2:
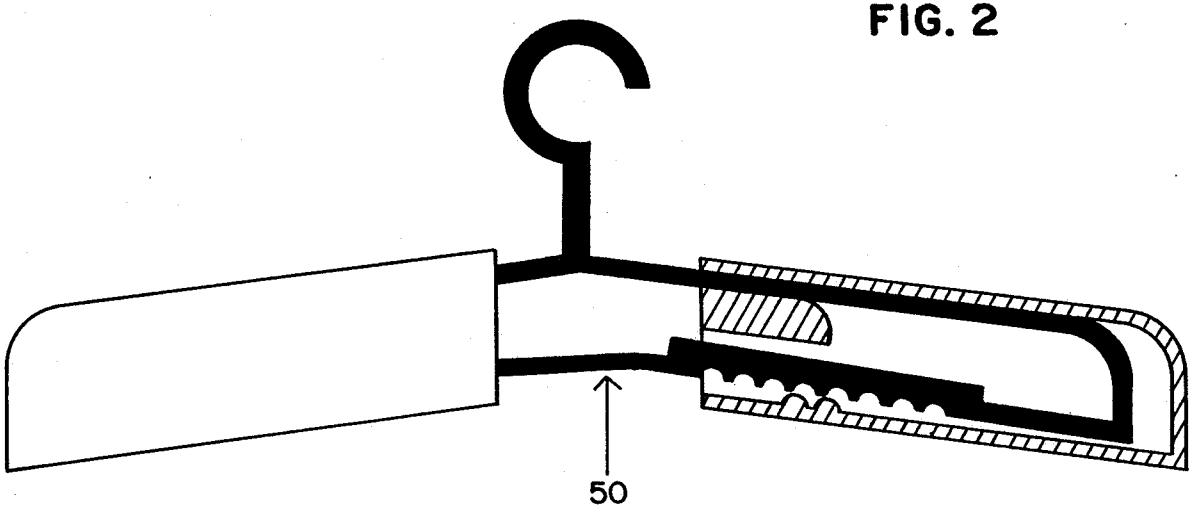
FIG. 2 is a front elevation view showing the lower edge of the hanger of the invention in a biased position and the sleeve in an extended position.

Each of said arms 11 is comprised of an interconnected top edge 13 and bottom edge 15. Edges 13 and 15 are interconnected at an end piece at the extremity 14 of the respective arm 11 to form a generally u-shaped perimeter and are biasable, either inwardly toward each other, or, in a preferred embodiment, the upper edge remains rigid so as to maintain its form while the lower edge is biasable upwardly in the direction of arrow 50 on FIG. 2. Top edge 13 of arm 11 extends outwardly and downwardly from horizontal plane B normal to vertical center line 12 at an angle A of between about 5° and about 10° preferably, angle A is about 7°.

The arms 11 of the hanger of the invention may also be contoured in a manner which, when clothing is hung thereupon, more closely approximates the fit and contour of the human chest and shoulders. This contour may be provided by angling the arms 11 forward from a vertical plane which encompasses vertical line 12. The angle of forward slope is between 15–30°, preferrably 20–27°, most preferrably 25°.

Main body member 10 may be constructed of various materials which may be supple, rigid or a combination of the two, depending upon the particular embodiment of the invention. Exemplary of such materials are plastics or metals, with an especially preferred embodiment being constructed of a plastic material which is rigid at top edge 13 and resilient at bottom edge 15.

The garment hanger of this invention also comprises a pair of sleeves 20. These sleeves may be constructed of either rigid or resilient materials such as plastic.

Each of sleeves 20 is slideable over an arm 11 when bottom edge 15 is in a biased position. Sleeves 20 are held in a fixed position relative to arms 11 when arms 11 are in an unbiased position. Preferably, sleeve 20 has one or more stop means 22 such as a detent on interior surface 21 and arm 11 has a plurality of spaced stop-receiving means 23 such as notches for receiving stop means 22 when arm 11 is in an unbiased position. The stop-receiving means 23 are preferably spaced such that the overall extended lengths of arm 11 and sleeve 20 correspond to a series of conventional garment sizes when stop means 22 is engaged within one or more stop receiving means 23.

Sleeves 20 may be fabricated from various materials such as plastics or rubber, preferrably clear plastic. Preferably the outer edges of sleeves 20 are rounded or tapered to prevent damage to the garments.

The hanger of the invention further comprises support means which is incorporated into the structure of sleeve 20. Support means 24 is preferably a solid block comprised of top edge 25, bottom edge 26, inner edge 27 and contoured outer edge 28. The four edges of support means 24 form the perimeter of the solid block which is support means 24. Support means 24 is incorporated into the structure of sleeve 20 at the innermost extremity of sleeve 20 such that the inner edge 29 of sleeve 20 and the inner edge 27 of support means 24 are even with one another. Support means 24 is incorporated into the structure of sleeve 20 in a position which allows top edge 25 of support means 24 to be slideably engaged with the underside 16 of top edge 13 of hanger arm 11.

Top edge 25 of support means 24 is contoured to conform to the shape of underside 16 of top edge 13 of hanger arm 11. When top edge 25 of support means 24 is slideably engaged with underside 16 of top edge 13 of arm 11, the engagement of top edge 25 of support means 24 with underside 16 of top edge 13 of arm 11 provides support so that when sleeves 20 are extended to their greatest extremity, and a garment is hung thereon, no dipping of sleeves 20 occurs.

Contoured outer edge 28 of support means 24 of sleeve 20 is preferably rounded so as to fit the countour of the outer end piece extremity 14 of arm 11 when sleeve 20 into which support means 24 is incorporated is extended to its furthest extremity.

Support means 24 is constructed so that its length in relationship to stop means 22 and stop receiving means 23 allows sleeve 20 to be extended to its furthest desired length before contoured outer edge 28 of support means 24 engages extremity 14 of arm 11.

Figure 5:
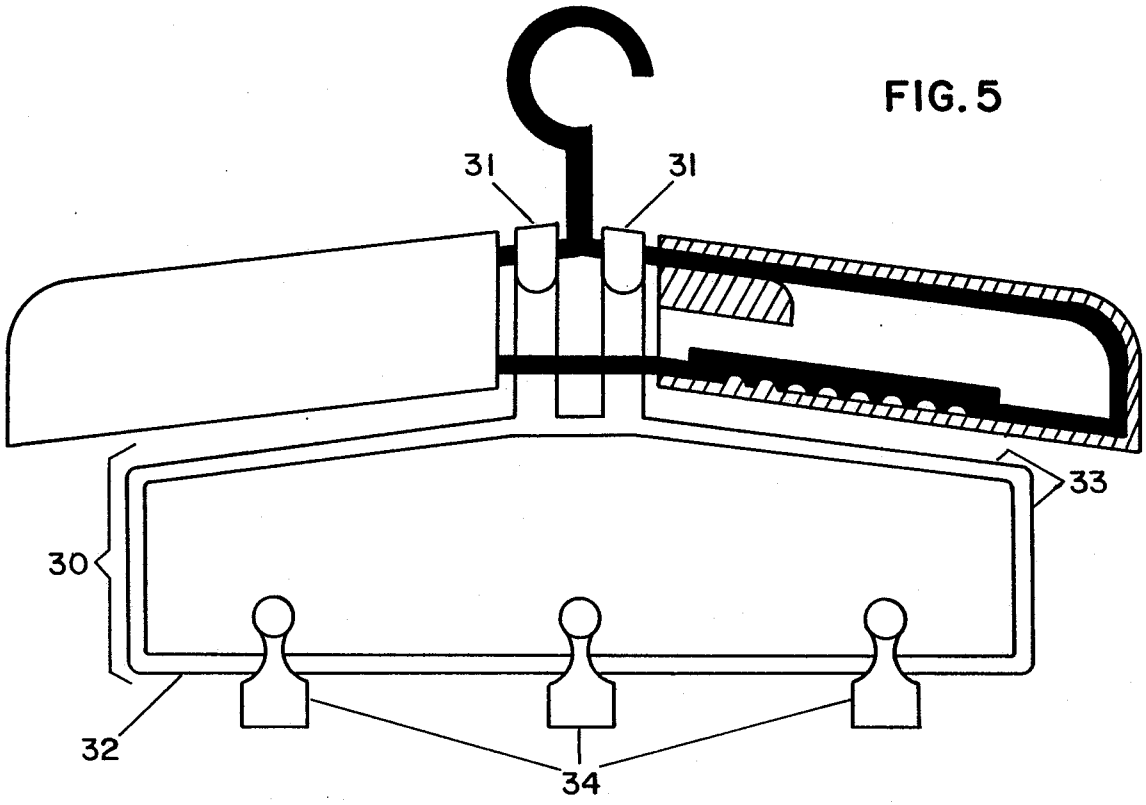
FIG. 5 shows a preferred embodiment of the invention which has been affixed with a suspension, the bottom side of which is a crosspiece for suspension of garments such as pants, to which clips can be affixed for the suspension of garments such as skirts.

In another preferred embodiment of the invention, the garment hanger further comprises a second body member 30 as illustrated by FIG. 5. Second body member 30 comprises a means, such as hooks 31 for attaching second body member 30 to main body member 10 and a means 32 for securing garments such as trousers, skirts, and the like. Preferably means 32 is a rod which is horizontally disposed when the garment hanger is suspended from a support. Means 32 may be suspended from attaching means 31 by connection means 33. Garment attachment means 34 may comprise clips or other fasteners for securing garments such as skirts.

In another preferred embodiment as illustrated by FIG. 6, main body member 10 may be affixed with circular suspension means 35 which is adapted for suspension upon floor standing support means 36. The circular construction of suspension means 35 can also be adapted for use in public places such as hotels wherein the circular design which completly circumscribes a support means such as a clothes bar in a closet would tend to inhibit removal.

What I claim is:

1. An adjustable garment hanger comprised of:

a suspension means for suspending said hanger from a support, said suspension means defining the vertical centerline of said hanger;

a body portion depending from said suspension means and having oppositely oriented segments disposed about said centerline, each of said segments further comprised of a substantially rigid upper arm which extends outwardly from said vertical centerline to a respective vertically disposed extremity which is generally parallel to said vertical centerline and terminates in a common, resilient lower arm which extends between the vertically disposed extremities; and, a pair of sleeve members, each of said sleeve members encloses a respective segment of said body member in the vertical plane, moves toward and away from said centerline to adjust the hanger width according to the garment to be supported by the hanger and is held in position by said common, resilient lower arm, each of said sleeve members further including a support means positioned beneath and adjacent to said upper arm and contoured to abut a respective vertically disposed extremity and limit movement away from said centerline.

2. The garment hanger according to claim 1, wherein each of said sleeves has a stop means on an interior surface thereof and the resilient lower arm has a series of means for receiving said stop means.

3. The garment hanger according to claim 2, wherein said stop means is a detent and each of said receiving means is a notch.

4. The garment hanger according to claim 1, wherein each of said upper arms extends downwardly from a horizontal plane normal to said vertical centerline at an angle of between about 5° and about 10°.

5. The garment hanger according to claim 1, wherein said body segments extend from a vertical plane which encompasses said vertical centerline by an angle of between about 15° to about 30°.

6. The garment hanger according to claim 1, which further comprises a second body member having a first means for attaching said second body member to said hanger and a second means for securing garments to said second body member.

7. The garment hanger according to claim 1, wherein said suspension means is a hook.

8. The garment hanger according to claim 1, wherein said suspension means is a complete circle.

9. An adjustable garment hanger comprised of:

a suspension means for suspending said hanger from a support, said suspension means defining the vertical centerline of said hanger;

a body portion depending from said suspension means and having oppositely oriented segments disposed about said centerline, each of said segments further comprised of a substantial rigid upper arm which extends outwardly from said vertical centerline to a respective vertically disposed extremity which is generally parallel to said vertical centerline and terminates in a common, resilient lower arm which extends between the vertically disposed extremities, said oppositely oriented segments define the hanger's minimum width; and, a pair of sleeve members, each of said sleeves encloses a respective segment of said body member in the vertical plane, has at least one open end and is slidable at said open end about the respective segment, includes contoured support means adjacent said open end, for supporting said upper arm, as it moves toward and away from said centerline to adjust the hanger width according to the garment to be supported by the hanger, and abutting a respective vertically disposed extremity to limit movement away from said centerline and is held in position by said common, resilient lower arm.

* * * * *